US006802146B2

(12) United States Patent
Gay

(10) Patent No.: US 6,802,146 B2
(45) Date of Patent: Oct. 12, 2004

(54) SIGN SUPPORT FOR RETAIL MERCHANDISING SHELVES

(76) Inventor: Kenneth R. Gay, 6423 Walden Cir., Dublin, OH (US) 43016

( * ) Notice: Subject to any disclaimer, the term of this patent is extended or adjusted under 35 U.S.C. 154(b) by 124 days.

(21) Appl. No.: 10/277,496

(22) Filed: Oct. 22, 2002

(65) Prior Publication Data

US 2004/0074126 A1 Apr. 22, 2004

(51) Int. Cl.[7] ..... G09F 3/20

(52) U.S. Cl. ..... 40/651; 40/642.02; 40/492; 211/119.003

(58) Field of Search ..... 40/651, 642.02, 40/492; 211/119.003, 90.2; 248/302, 303, 215

(56) References Cited

U.S. PATENT DOCUMENTS 5,934,633 A * 8/1999 Padiak et al. ..... 248/228.8
6,108,956 A * 8/2000 Conway et al. ..... 40/651
6,434,871 B2 * 8/2002 Conway ..... 40/651

* cited by examiner

*Primary Examiner*—Cassandra H. Davis
(74) *Attorney, Agent, or Firm*—Mueller and Smith, LPA

(57) ABSTRACT

An open wire frame sign support for mounting at the forward edge region of a customer accessible merchandising shelf. A wire bracket is configured for attachment to the forward edge region of the shelf which incorporates a slot defining assembly within which is disposed a stop member below which a loose hinging component is defined and above which an upwardly open slot is formed. A rectangular wire frame is provided having a centrally lower disposed hinge support from which angularly outwardly extend a lower disposed hinge loop which engages the lower hinging component of the slot in a loose hinging fashion and a tongue member which is hand moveable into engagement with the open slot of the bracket.

25 Claims, 6 Drawing Sheets

10
16
17
18
36e
36d
36c
36b
36a
19
27
15
14
34e
34d
34c
34b
34a
50
54e
3
52
54d
54c
54b
54a
12
42
26
29
28
3
40e
40d
40c
40b
40a
58
28
56
60e
60d
60c
60b
60a
38
21
46e
46d
46c
46b
46a
20
48a
30
74
70
76
72
44
62
23
66a
78
66b
68a
80
68b
24
64
22

FIG. 2
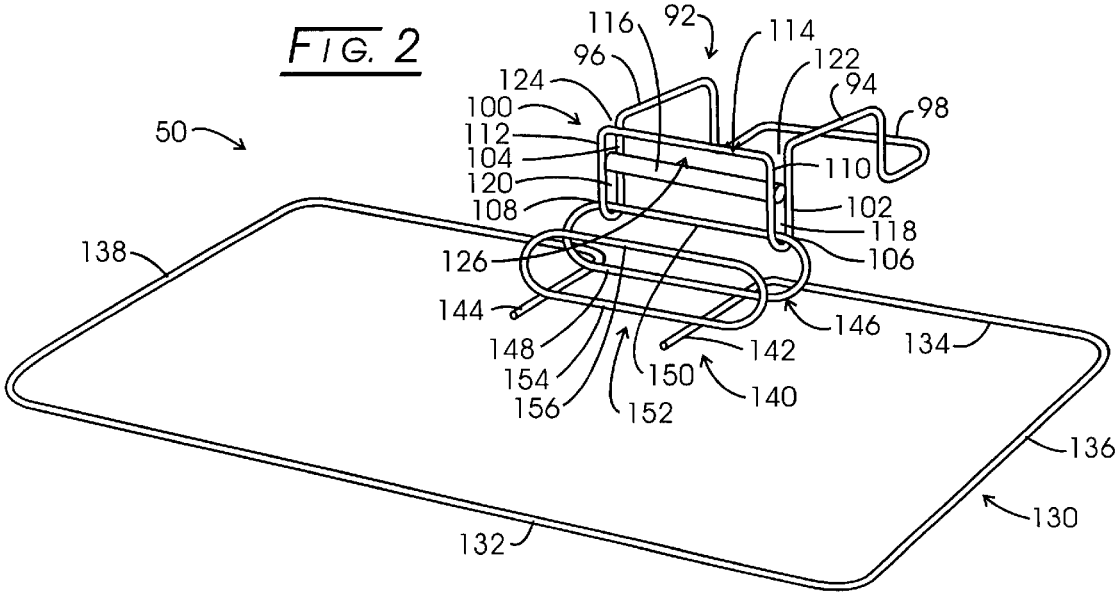
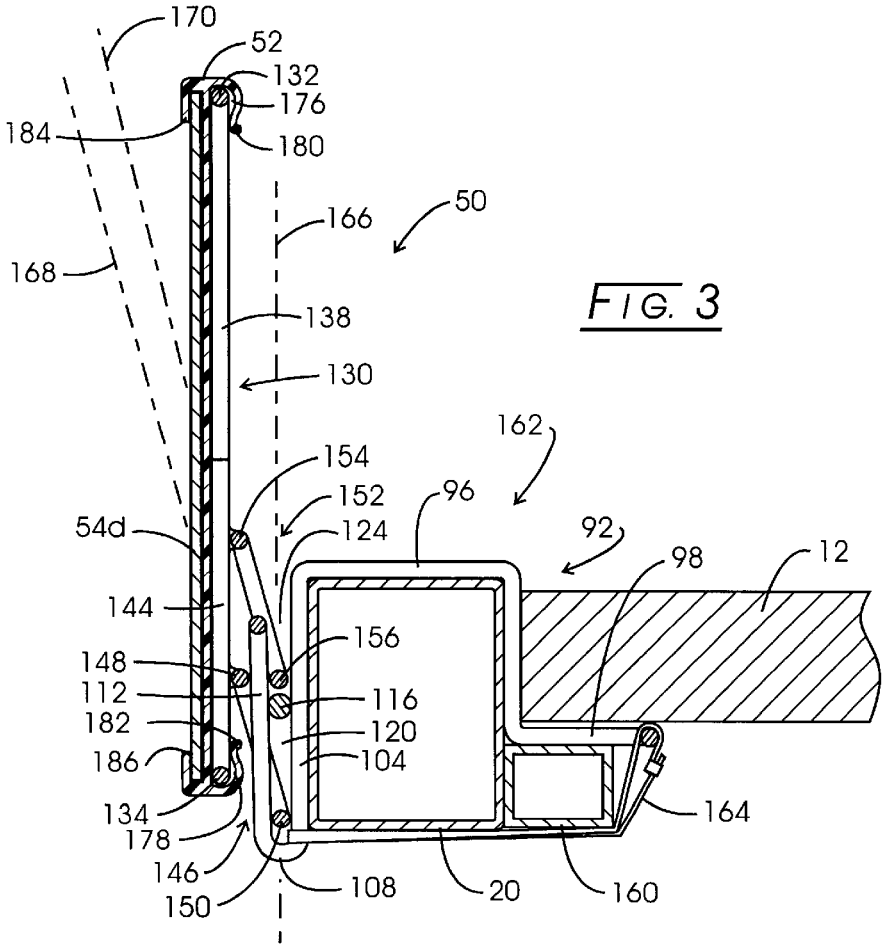
FIG. 3

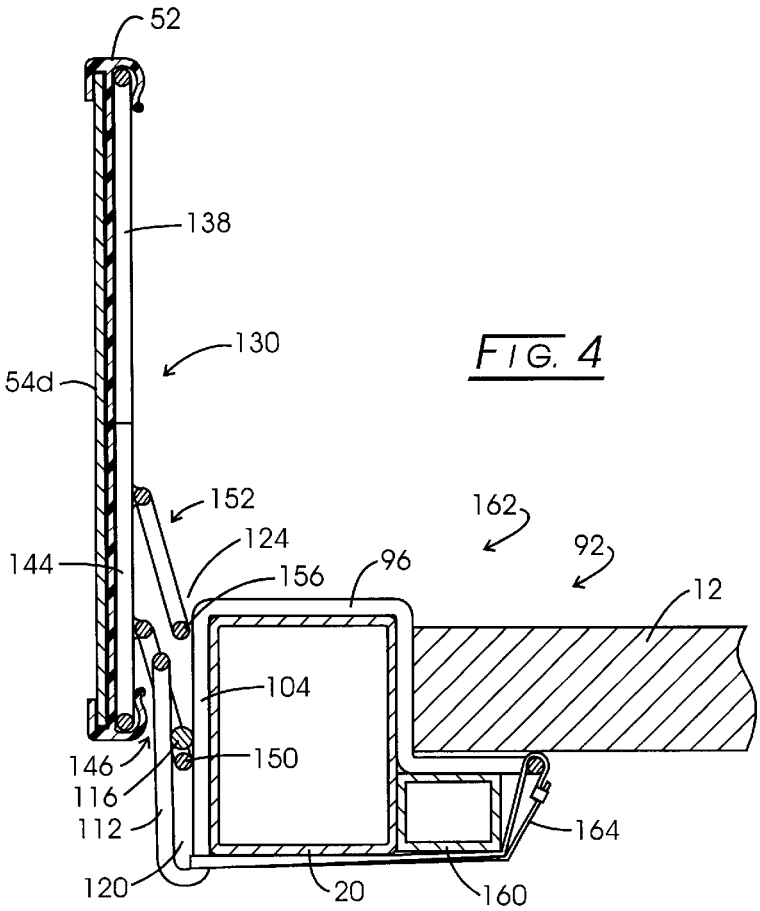
FIG. 4
FIG. 5
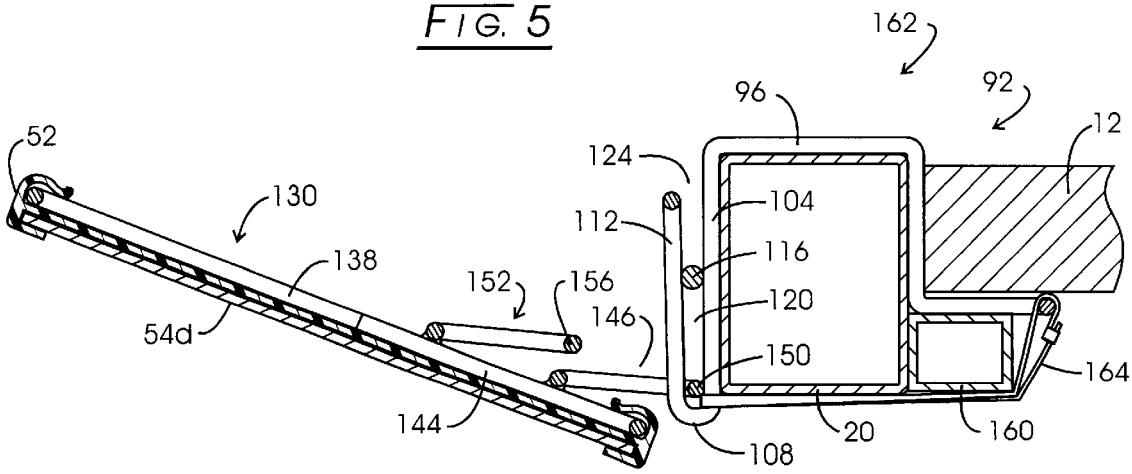

SIGN SUPPORT FOR RETAIL MERCHANDISING SHELVES

CROSS-REFERENCE TO RELATED APPLICATIONS

STATEMENT REGARDING FEDERALLY SPONSORED RESEARCH

Not applicable.

BACKGROUND OF THE INVENTION

Retail merchandising practices have undergone significant changes over the past several decades. Because the customer or consumer base now remains stable or something of a fixed number, retailers no longer create facilities to serve new markets but expend their energy and resources to glean customers from their competition. As a consequence, as such competition intensifies, retailing practices must create in-store sales innovations. Generations ago during the earlier years of what is now considered to be modern retailing, brand name promotion was successfully undertaken through the media of the press and airwave. Now, such media has undergone a dilutionary effect, having only nominal input on the retail shopper in consequence of the extensive proliferation of information media. As a result, branding practices no longer necessarily translate into sales. Shoppers now are susceptible to impressions and information they acquire in the stores themselves.

> That means that while branding and traditional advertising build brand awareness and purchase predisposition, those factors do not always translate into sales. The standard tools of marketing work, they just don't work anywhere near as well as they used to. Many purchasing decision are made, or can be heavily influenced, on the floor of the store itself.

> As a result, an important medium for transmitting messages and closing sales is now the store and the aisle. That building, that place, has become a great big three-dimensional advertisement for itself. Signage, shelf position, display space and special fixtures all make it either likelier or less likely that a shopper will buy a particular item (or any item at all). The science of shopping is meant to tell us how to make use of all those tools: How to design signs that shoppers will actually read and how to make sure each message is in the appropriate place. How to fashion displays that shoppers can examine comfortably and easily. How to ensure that shoppers can reach, and want to reach, every part of a store. It's a very long list—enough to fill a book, in my opinion. *Underhill*, "Why We Buy, The Science of Shopping", Simon & Schuster, 1999, pp32–33.

Many relatively larger retail establishments turn to what is referred to as the "open sell" approach to the display of goods. This approach places inventory quantities of goods at the aisleways where the customer can touch, smell or try them unmediated by now few and scarce sales clerks.

> In 1960, 35 percent of the average Sears store was given over to storage. Today it's less than 15 percent. Today it's almost pointless to ask a clerk if an item you want is in the back room. In some stores there is no back room to speak of. Everything is either on the shelves or in the little storage cupboards above or below. It's a brilliant innovation—what good is anything when it's in storage? You can't buy it unless you can find a clerk, and what do you do when there are too few clerks, or too few knowledgeable ones, or too few clerks who are actively trying to help you buy anything? It makes perfect sense to just put it all out there as invitingly and enticingly and conveniently as possible, and then let the shoppers and their good senses discover the stuff on their own. *Underhill* (supra) pp 165–166.

In the large discount retail environment, the aisle-walking customer is confronted with heavy-duty shelving supporting cardboard cases of merchandise, the cases being cut away to make access to the goods which they retain. Retailers refer to this form of display with the argot, "cut case" merchandising. For cut case merchandising to be effective, signage is required to immediately apprise the customer of the technique of use of the goods, important ingredient data and source identification. Thus, the signage must be large enough to draw customer attention, but still inobtrusive to the extent making access to the encased goods easy. Spring biased or hanging hinge signs are problematic, typically functioning to irritate the customer, an aspect militating against a repeat visit to the store on the part of the frustrated consumer.

> Not long ago Wal-Mart tried an experiment: It began replacing traditional shelves with a system of bins. Instead of a shelf facing of aspirin bottles, say, the shopper would see a blowup of the aspirin label. Under that blowup was the bin, into which the aspirin bottles had been dumped.

> This made an enormous difference. First, it solved the problem of stocking—a clerk could just roll a trolley of merchandise to the aisle, open the bin, dump in the goods and move on. No more straight lines. The shoppers liked it better, too—instead of facing a row of bottles with tiny print, they saw a large, east-to-read version of the label. It was much easier on the eyes, especially for older shoppers. Wal-Mart's main concern in making the change was whether shoppers would perceive the bins as being somehow cheaper and lower in quality than the shelves. In fact, just the opposite was true—shoppers interviewed said they thought the bins were an upgraded display system. A very elegant solution. *Underhill* (supra) p 188.

BRIEF SUMMARY OF THE INVENTION

The present invention is addressed to sign support apparatus employed with retail merchandising shelving of a variety requiring unaided customer access to shelf merchandise. Having particular utility in conjunction with cut case merchandising, the sign supports are of very light weight and exhibit a high level of reliability while remaining sufficiently simple in their operation. In the latter regard, the shelf supports are, in effect, "self teaching" in nature with respect to the customer seeking access to shelved, open cartons of merchandise. The sign supports rely in part upon the established tendency of retail customers to touch both merchandise and the display-based objects near them. Only a slight upward movement imparted to the sign support will inherently invite the customer to retract the sign carrying support with a loose pivoting maneuver. No spring biasing is utilized which would otherwise interfere with access to the shelf merchandise. In the latter regard, a spring biased assemblage causing the shelves to return would represent an aggravation to the customer, a condition to be avoided in a modern retail environment utilizing fewer and fewer clerk personnel. A simple relifting of the light sign support restores it to its initial, generally vertical orientation within sight lines from the customer eye position.

Another feature and object of the invention is to provide a sign support apparatus for attachment at the forward edge region of a retail merchandising shelf. The apparatus includes a bracket which is connectable at the shelf forward edge region which has a forwardly disposed vertically extending hinge component extending from a bottom surface to define a slot with an upwardly open top. A stop member is fixed within the slot upwardly a latching distance from the bottom surface to define a retention component developing a loose hinging action and is spaced downwardly from the slot top a receiver distance to define an open receiver slot. A sign support frame is provided having a bottom edge, a top edge and oppositely disposed side members and an intermediately disposed hinge support extending from its bottom edge. A hinge loop is fixed to and extends from the frame hinge support which has an engagement portion extending through and moveable within the bracket retention component from a location adjacent the hinge component bottom surface into freely abutting engagement with the stop member. A tongue member is fixed to and extends from the frame hinge support which is spaced above the hinge loop and has an engagement portion positionable at a vertical location over the slot top when the hinge loop engagement portion is in abutting contact with the stop member. The tongue member is slidably moveable from the vertical location downwardly within the open receiver side into abutting contact with the stop member.

As a further feature and aspect of the invention, a sign retainer is provided having a flat sign support face extending between rearwardly disposed upper and lower support channels which are slidable over the support frame top edge and bottom edge. The sign retainer can be formed as a light polymeric extrusion.

Other objects of the invention will, in part, be obvious and will, in part, appear hereinafter.

The invention, accordingly, comprises the apparatus possessing the construction, combination of elements and arrangement of parts which are exemplified in the following detailed description.

For a fuller understanding of the nature and objects of the invention, reference should be made to the following detailed description taken in connection with the accompanying drawings.

BRIEF DESCRIPTION OF THE DRAWINGS

FIG. 2 is a perspective view of the wire frame components of a sign support structure according to the invention;

FIG. 3 is a partial sectional view taken through the plane 3—3 shown in FIG. 1 and illustrating the geometry of the sign support apparatus as it retains signage in a vertical orientation;

FIG. 4 is a sectional view of the sign support shown in FIG. 3 but in an orientation wherein the sign frame has been elevated;

FIG. 5 is an illustration of the sign support apparatus of FIG. 5 but showing the sign support in a retracted orientation;

DETAILED DESCRIPTION OF THE INVENTION

A salient feature of the sign support apparatus of the invention resides in the simplicity of its movement by a customer out of an upright orientation partially blocking customer access to the merchandise which it importantly describes. In this regard, while the signage extends upwardly across the cut case retail merchandise to give the customer that necessary information about a product, it has a self-teaching aspect which relies upon the natural tendency of a customer to touch the sign in the course of reaching and thus seeking to touch the merchandise it describes. A customer wishing to move the signage to gain better access to the merchandise carrying boxes behind it will inherently lift it and pivot it out of the way. Such a procedure is quite simply carried out, inasmuch as the sign support apparatus is of very low weight, being fabricated in open wire fashion and utilizing an extruded polymeric sign support. Of added importance, there are no spring-biased mechanisms to retain the signage in a vertical orientation which would otherwise evoke customer irritation with a sign that won't stay retracted.

> Touch and trial are also more important than ever to the world of shopping because of changes in how stores function. Once upon a time store owners and salespeople were our guides to the merchandise they sold. They were knowledgeable enough, and there were enough of them, to act as the shopper's intermediary to the world of things. We could take a clerk's word for something because he or she had been right so many times before. That was, not coincidently, back in the day of grand wooden cabinets with glass fronts behind which goods were displayed, the heyday of the hardware store and the haberdasher and the general store, when space was clearly divided between shoppers and staff. *Underhill* (supra) p 165.

So, then, the principle seems simple enough: Shoppers want to experience merchandise before buying it. Therefore, the main function of a store is to foster shopper-merchandise contact. Stores should be begging shoppers to touch or try things, though frequently they make it as difficult as possible. *Underhill* (supra) p 168.

Figure 1:
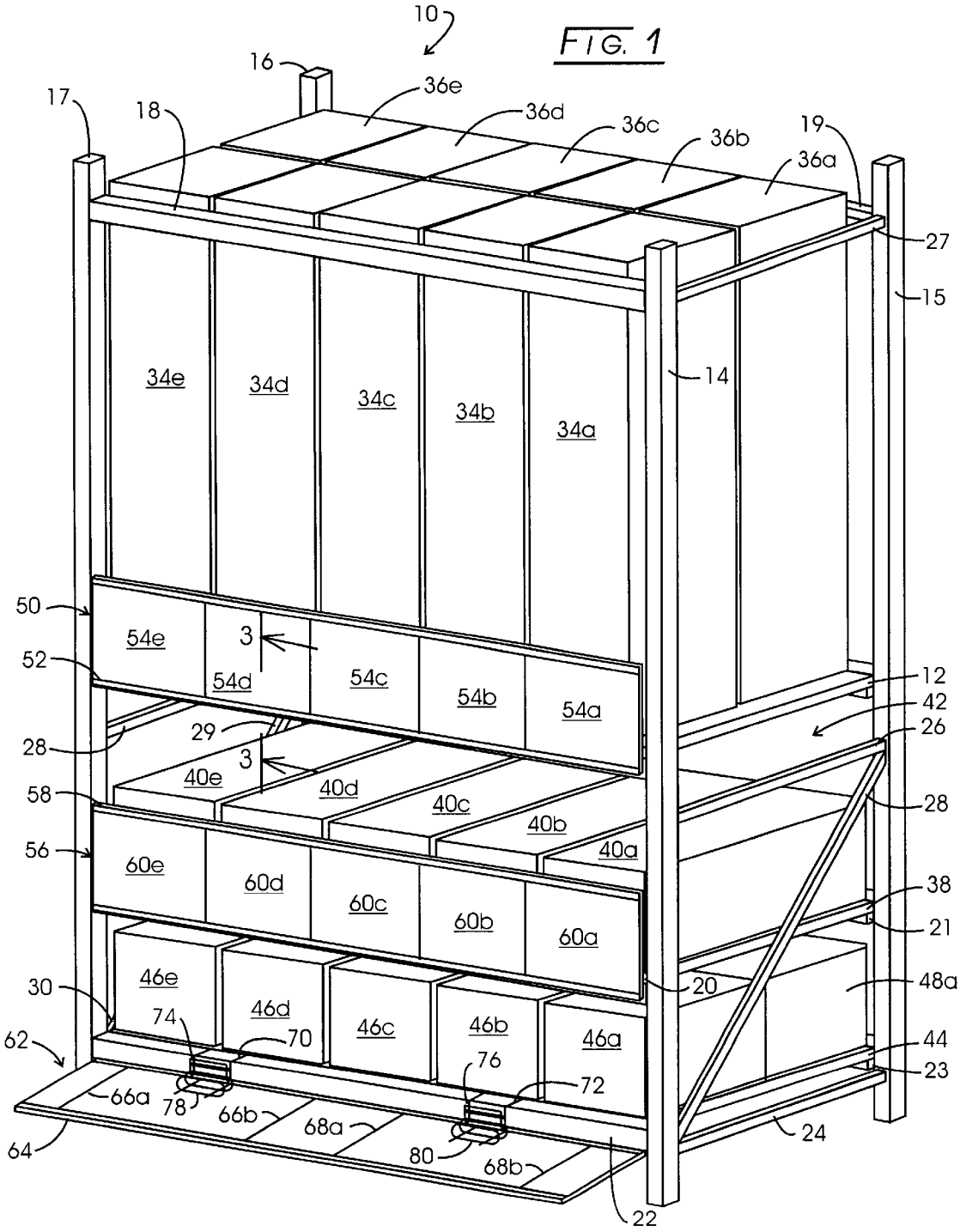
FIG. 1 is a perspective view of a heavy duty retail merchandising shelf structure incorporating the sign support apparatus of the invention and illustrating carton-based merchandising.

Referring to FIG. 1, a merchandising system following a cut case form of customer access is represented generally at 10. For demonstrative purposes, the system 10 is shown having an upper shelf 12 supported by four square tube posts or columns 14–17. Columns 14–17, in turn, are maintained in appropriate verticality by forward and rearward box beams 18–23. Rigidity for the system 10 is provided by a network of side beams certain of which are revealed at 24–30. With the arrangement, forward access to the retail merchandise supported in system 10 is made available to the customer. For illustrative purposes, relatively tall upstanding cartons 34*a*–34*e* are disposed forwardly on shelf 12. Cartons 34*a*–34*e* are made accessible to the customer as they carry unspecified merchandise. Typically, the cartons will bear no promotional information but will be identifiable only by a printed part number and/or bar code. Very often, the cartons 34*a*–34*e* are slit diagonally along their length with utility knives to reveal internally disposed merchandise such as brooms, mops and the like which for the instant demonstration will have an elongate dimension characteristic. Positioned behind cartons 34*a*–34*e* are storage-based supplementary cartons 36*a*–36*e* which are slid forwardly upon removal of the forwardly positioned cartons 34*a*–34*e*.

Spaced next below shelf 12 is a shelf 21 which is shown supporting merchandise containing elongate but horizontally disposed cartons 40*a*–40*e*. Cartons 40*a*–40*e*, as before, may be relatively unmarked carrying no advertising data other than part numbers and bar codes. Additionally, the cartons may be slit diagonally by store personnel to reveal their internal contents. Accordingly, a relatively larger spacing as represented generally at 42 is provided below shelf 12 to provide an appropriate customer viewing angle.

Next positioned below shelf 38 is a shelf 46 which is at the lower region of system 10 and is seen to support cartons 45*a*–46*e* forwardly. Cartons 46*a*–46*e* generally will have no advertising located thereon and are sold per se as cartons generally with bar codes and part numbers. Supplementary or storage cartons may be positioned behind these cartons, one of which is revealed at 48*a*.

In general, all of the promotional and descriptive data associated with the merchandising cartons within system 10 is provided by shelf supported signs. In this regard, a sign support apparatus represented at 50 is attached to the forward edge region of shelf 12. Seen in the figure is a light weight polymeric extrusion 52 which carries signage 54*a*–54*e* identifying and describing the merchandise retained within respective cartons 34*a*–34*e*. In general, the sign support 50 will retain the signage 54*a*–54*e* in a vertical orientation inasmuch as it is at an elevation above the floor well within the sight angle of a customer, for example, walking in an aisle adjacent to system 10.

In similar fashion, the forward edge region of shelf 38 supports an upstanding sign support apparatus represented generally at 56 which incorporates a light weight polymeric extrusion 58 which, in turn supports signage 60*a*–60*e* providing descriptive data and any promotional information associated with the merchandise in respective cartons 40*a*–40*e*. The apparatus 56 is shown in a vertical orientation. To improve customer sight angle viewing it may be tilted inwardly in the sense of shelf 38 to facilitate viewing from a customer sight or eye position.

Merchandising systems as at 10 are predicated upon a customer being able to access the merchandise or cartons generally without the aid of ever diminishing numbers of store clerk personnel. Accordingly, the sign support apparatus as shown generally at 50–56 must be retractable in a manner permitting it to maneuver entirely out of the plane of an associated supporting shelf so as to provide sliding access to cartons and easy access for touching purposes of the merchandise within cartons. Once so pivoted out of otherwise physical interference with the merchandise, the sign support apparatus should, as it were, stay put. In this regard, spring biasing of the signage to an upright position is disadvantageous. Such a retracted sign support apparatus is represented in general at 62 as being attached to the forward edge region of shelf 44, and in particular to forwardly disposed box beam 22. As before, the apparatus 62 is shown having a light weight polymeric extrusion 64 which carries forwardly disposed signage (not shown). Extrusion 64 is shown being supported by two open wire and quite light sign support frames. The side members of these rectangular frames are shown at 66*a*–66*b* and 68*a*–68*b*. Frames and extrusion 64 are attached to the forward edge region of shelf 44 at box beam 22 by wire-form brackets 70 and 72 having upwardly open slots shown respectively at 74 and 76. Slots 74 and 76 are configured to receive the engagement portion of a tongue member fashioned as a wire loop. These tongue members are shown at 78 and 80 extending from components of the sign support frames. The frame support 62 may have an inward can't or angulation so as to promote its viewability from the eye station of a customer standing in an adjacent aisle. Additionally, a shelf may be associated with box beam 18. While such shelving is generally inaccessible to customers, it sometimes is employed for storage purposes. Not shown in the figure, is another sign support assembly which may be associated with such an upper shelf in conjunction with box beam 18. Such signage typically is canted downwardly to improve customer viewability.

The open wire frame components of the sign support apparatus are revealed in perspective fashion in FIG. 2. Looking to that figure, the apparatus 50 is seen to comprise a bracket represented generally at 92 which may have a variety of configurations depending upon the structuring of the forward edge region of a given shelf. For the instant embodiment, bracket 92 is configured with spaced apart rectangular beam engagement members 94 and 96 which extend rearwardly in continuous fashion to an undershelf loop 98. Bracket 92 further is configured having a forwardly disposed hinge component shown generally at 100 which is formed with spaced-apart inward wire hinge components 102 and 104 which extend vertically downwardly along the shelf forward edge region at box beam 20 to respective bottom locations 106 and 108. From locations 106 and 108, the continuous wire structure is bent to provide vertically disposed outward wire hinge components shown respectively at 110 and 112. In general, a slot is provided with an upwardly open top in consequence of the combination of components 102 and 104 with components 110 and 112. The slot is represented generally at 114. Slot 114 is seen to support a wire stop member 116 having a widthwise dimension or diametric extent selected to contact components 102 and 110 and components 104 and 112. The stop member 116 is welded to these components and, with the arrangement shown, functions with the slot 114 to define an elongate closed portion of the slot 114 as shown at 118 and 120. In this regard, the stop member 116 is positioned above the bottom locations 106 and 108 to define a retention component of the hinge. Additionally, stop member 116 is spaced downwardly from the slot 114 tops as at 122 and 124 a distance defining an open receiver slot represented generally at 126. Note that the widthwise dimension or diametric extent of stop member 116 is greater than the corresponding dimension of the wire bracket structure. This develops a "loose" hinge action.

Connected to the bracket 92 is an open wire sign support frame represented generally at 130. Frame 130 is formed having a top edge 132, a bottom edge represented generally at 134 and oppositely disposed side members 136 and 138. Bottom edge 134 is configured to include a hinge support represented generally at 140 which is formed as inwardly upwardly bent spaced apart wire components 142 and 144.

Welded to components 142 and 144 and extending outwardly angularly from the frame 130 is a hinge loop represented generally at 146. Loop 146 is somewhat elongate in structure and includes a forward side 148 welded to components 142 and 144 and an angularly outwardly protruding elongate engagement portion 150 which extends through the bracket retention components or elongate but closed slots 118 and 120. It may be observed that engagement portion 150 is slidable from the vicinity of the bottom locations 106 and 108 into freely abutting engagement with the bottom side of stop member 116. Thus, while the hinge loop 146 remains captured below stop member 116, the entire frame assembly 130 may not only pivot about portion 150 but move vertically upwardly and downwardly with it.

Spaced above the hinge loop 146 is a tongue member represented generally at 152 which is configured as an elongate loop of identical configuration as hinge loop 146. The open wire tongue member is configured with somewhat elongate oppositely disposed parallel sides, one of which at 154 is welded to hinge support portions or members 142 and 144 and the opposite side or engagement portion 156 is configured to be slidably insertible within the slot 114 through the slot tops 122 and 124 into abutting engagement with the top surface of stop member 116. Accordingly, the frame 130 and associated hinge loop 146 and tongue member 152 are readily pivoted to a horizontal or downwardly vertical orientation from a vertical upward orientation wherein engagement portion 156 or the tongue member 152 is loosely installed within the open receiver slot 126 or the noted abutting contact with stop member 116. Due to its open wire frame configuration, the entire assemblage is very light and easily maneuvered by a customer.

Looking to FIG. 3, a sectional view of box beam 20 and associated shelf 12 is revealed. Note that a box beam ledge 160 is welded to the rearward side of box beam 20 and functions to forwardly support shelf 12 to define the forward edge region 162. FIG. 3 illustrates the sign assembly 50 either as the customer is just completing the reengagement of tongue member 152 into slot 124 or, alternately is commencing to elevate the assemblage to pivot it horizontally outwardly. Note that the bracket 92 is retained in position by a polymeric tie 164 extending from engagement with inward wire hinge component 104 and undershelf loop 98. A variety of configurations for brackets as at 92 may be employed. Assuming that the sign support is being retracted away from a vertical orientation by the customer, note that engaging portion 156 of tongue member 152 has moved vertically upwardly from abutting engagement with stop member 116. Similarly, engaging portion 150 of the hinge loop 146 is moving upwardly. In this regard, it should be noted that the spacing between sides 156 and 150 remains constant and is selected such that side 150 will not engage the lower portion 108 of the slot closed portion 120. Note additionally that the diametric extent of the component sides 150 and 156 is less than that of the stop member 116 to assure sliding and pivoting ease. The figure further reveals that sides 156 and 150 are symmetrically disposed about a common plane represented at 166. For the vertical arrangement shown, additionally, hinge loop 146 is shown to be symmetrically disposed about plane 168 while tongue 152 is symmetrically disposed about plane 170. These planes 168 and 170 are mutually parallel for the vertical sign support orientation shown.

FIG. 3 further reveals that the frame 130 supports the polymeric sign retainer 52. Retainer 52 may be formed of an extruded polystyrene material by way of example. For the purpose at hand, retainer 52 exhibits a resiliency permitting its slidable positioning over the wire sign support frame 130. In this regard, the retainer or support 52 extends between upper and lower support channels shown respectively at 176 and 178. In this regard, wire top member 132 is slidably retained within channel 176 and wire lower edge 134 is slidably retained within channel 176. Support 52 is retained in position inasmuch as panels 176 and 178 are configured with resilient, inwardly crimped or inwardly disposed edges shown respectively at 180 and 182 which compressibly engage side members 136 and 138 as well as components 142 and 144 of hinge support 140. Oppositely disposed from channels 176 and 178 are sign retention channels shown respectively at 184 and 186 which are seen slidably retaining sign 54*d*.

FIG. 4 reveals a next orientation of the sign support as it either is being retracted or positioned for movement into the vertical orientation shown in FIG. 3. Note that engaging portion 150 of hinge loop 146 is moving into an orientation of freely abutting adjacency with the lower side of stop member 116. Engagement portion or side 156 of tongue member 152 is poised over the open slot 124 and may be pivoted to a retracted orientation or permitted to vertically descend into engagement with the upper surface of stop member 116 as component 150 drops within slot 120.

Looking to FIG. 5, the sign support apparatus is shown in a retracted orientation permitting access to the shelf 12. In this orientation, the engagement portion 156 of tongue member 152 is fully released from slot 124 and the engaging portion inward side 150 of hinge loop 146 has slidably moved to the bottom of closed slot portion 120 into adjacency with bottom location 108.

Figure 6:
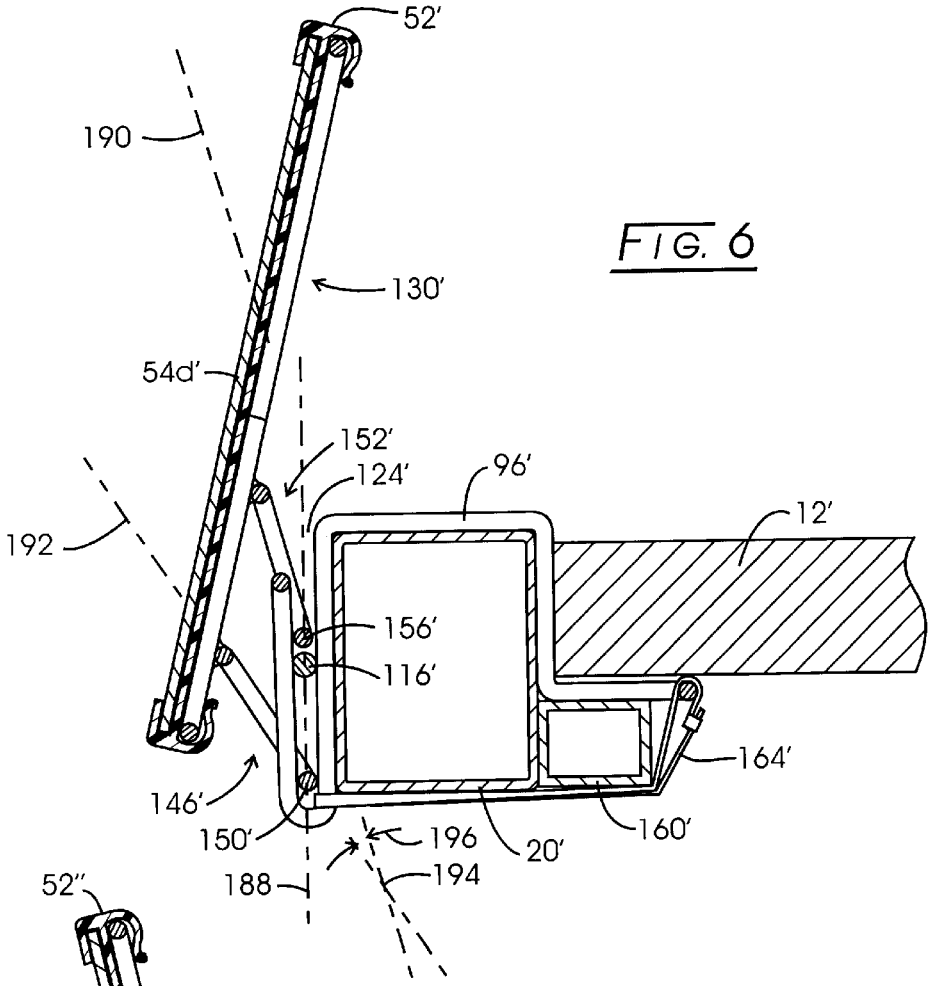
FIG. 6 is a partial sectional view of the sign support assembly according to the invention showing an implementation wherein the sign frame is tilted rearwardly.

As indicated earlier herein, the sign support apparatus of the invention can be configured such that the sign tilts rearwardly or forwardly, an arrangement particularly desirable where the signage is located at the top of a shelving unit or at floor level. FIG. 6 shows an adaptation for the latter floor level positioning where the sign apparatus is tilted rearwardly. For this arrangement, the same basic components are employed but with slightly modified orientations. Accordingly, the same identifying numeration is employed as was utilized in conjunction with FIGS. 2–5 but in primed fashion. FIG. 6 shows the sign support in its vertical or erected position. As before, the engaging portion 150' and the engaging portion 156' of the respective hinge loop and tongue members are symmetrically disposed about a common plane represented at 188. However, tongue member 152' now is disposed symmetrically about plane 190, while hinge loop member 146' resides within plane 192. Accordingly, when the sign is vertically mounted with the noted rearward tilt, planes 190 and 192 will intersect at a line 194 or location 194 and intersection angle 196 which is located rearwardly with respect to the shelf forward edge region.

Figure 7:
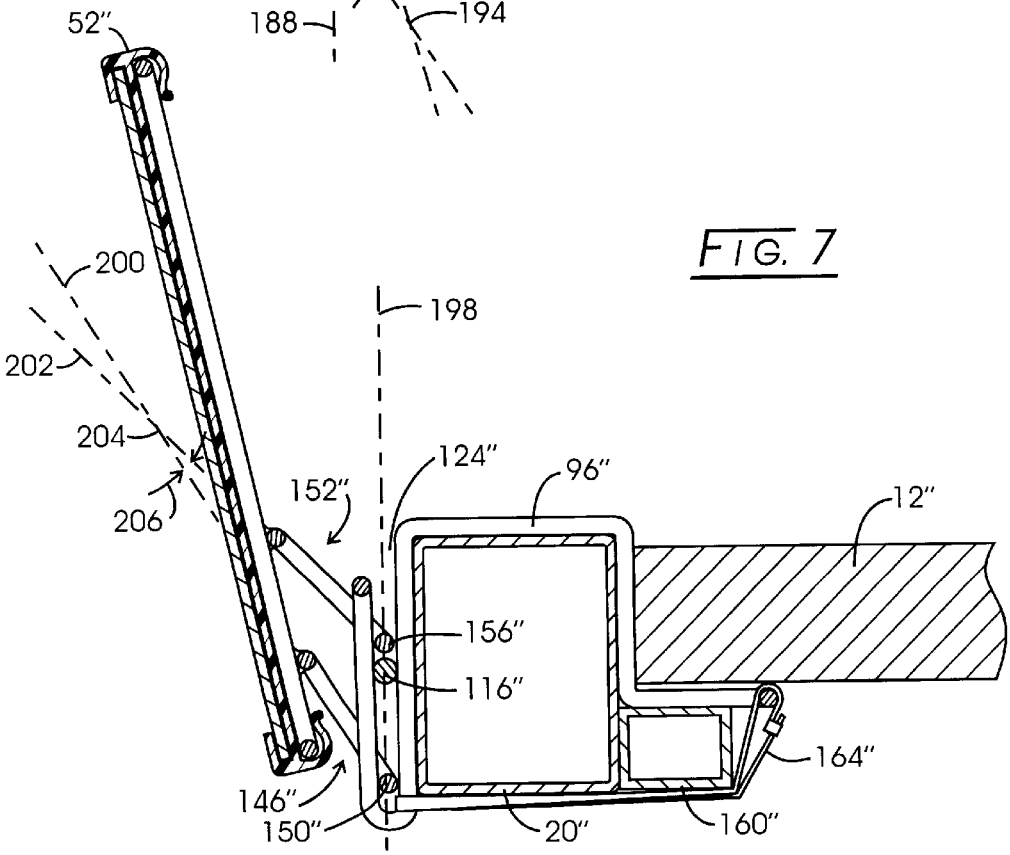
FIG. 7 is a partial sectional view of the sign support apparatus of the invention showing a configuration wherein the sign frame is tilted forwardly.

Looking to FIG. 7, an arrangement wherein the sign support apparatus is configured for evoking a forward tilt as may be utilized at a top or upwardly disposed shelf is presented. As before, the forward tilt is achieved by adjusting the positioning and angularity of the tongue member and the hinge loop. Accordingly, the same numeration as employed in conjunction with FIGS. 2 through 5 is utilized but in double primed fashion. In the figure, hinge loop portion or side 150" and tongue member engagement portion 156" are seen to again be disposed symmetrically within a common plane represented at 198. However, hinge loop 146" is disposed symmetrically about a plane represented at 200, while tongue member 152" is shown arranged symmetrically about a plane represented at 202. Planes 200 and 202 intersect at position 204 defining an intersection angle 206.

Figure 8:
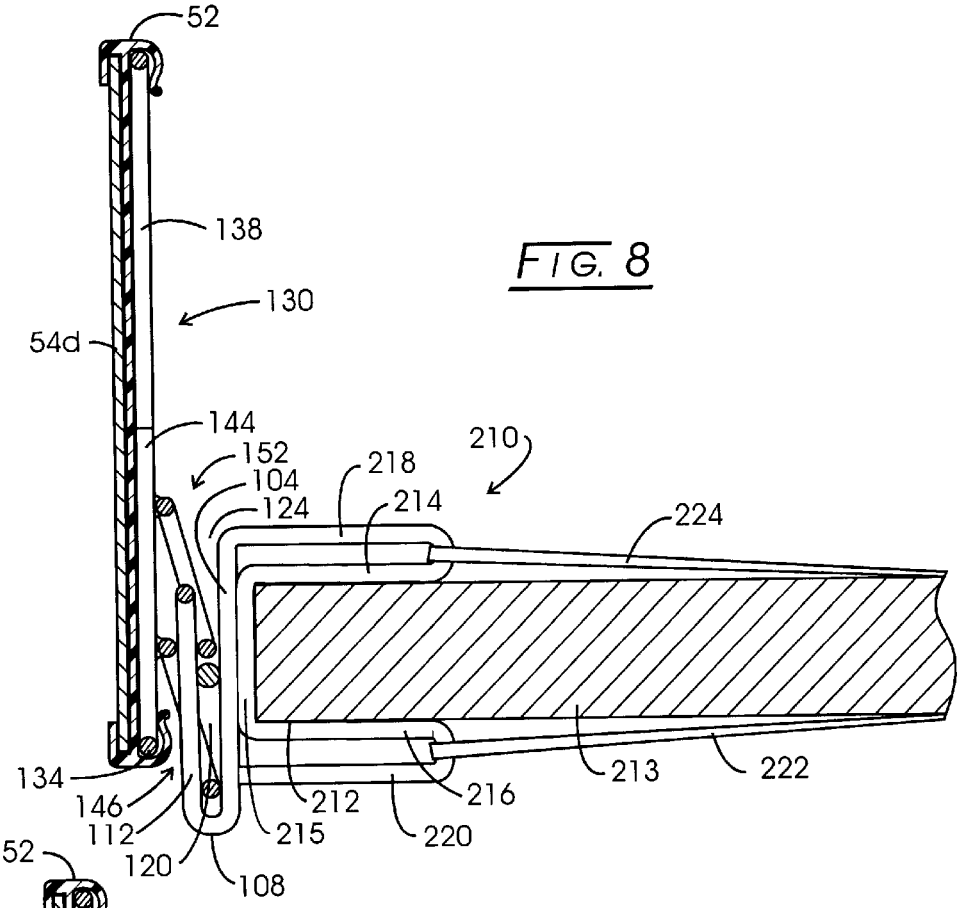
FIG. 8 is a sectional view of a sign support and shelf assembly according to the invention showing a variation of a bracket structure.

The apparatus of the invention may be provided with any of a variety of bracket configurations depending upon the structuring of the shelving involved. FIG. 8 depicts a bracket 210 as associated with a simplified shelf 213, for example, having no box beams or ledges as described earlier herein. With the exception of the bracket 210 and shelf 213, the components of the sign support assembly remain identical and thus the numeration employed with FIGS. 2–5 is continued. Bracket 210 is seen having a forward engagement slot 212 of rectangular profile which is formed of bent wire components 214–216. Component 214 is bent at 218 to form an upper loop whereupon it again is bent to provide an inward wire hinge component 104 which extends to bottom location 108, whereupon it is bent upwardly at 112 to provide the elongate closed portion of the slot 120. Similarly, component 216 is bent outwardly at 220 to provide a lower disposed loop. A polymeric stay 222 extends through the latter loop while corresponding polymeric stay 224 extends through the loop defined by components 214 and 218. Stays 222 and 224 are fixed rearwardly of the shelf 212.

Figure 9:
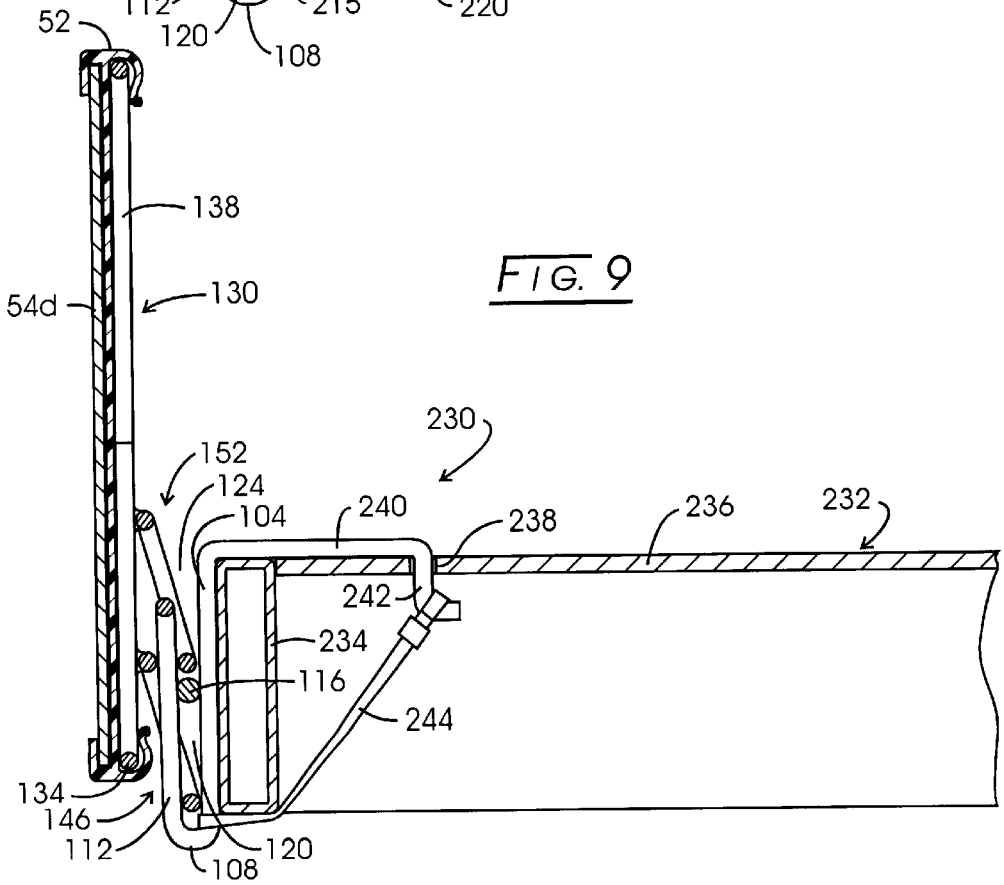
FIG. 9 is a sectional view of the sign support apparatus of the invention showing another bracket structuring.

Looking to FIG. 9, a bracket 230 is shown as it is adapted for utilization with a metal shelf shown generally at 232 having a forward metal box beam 234 and a metal top 236. Top 236 is configured with a sequence of apertures, one of which is shown at 238. Bracket 230 is of a general "L" shape having an upper horizontal component 240 which is bent to define an insert component 242 which extends through the aperture 238. Component 240 extends to be downwardly bent to define inward wire hinge component 104 which, in turn, extends to the bottom location 108 whereupon it is bent upwardly to define outward wire hinge component 112. Bracket 230 is retained in position by a polymeric tie 244 which extends through the elongate closed slot portion 120 then across the bottom of beam 234, whereupon it is secured to the insert 242.

Figure 10:
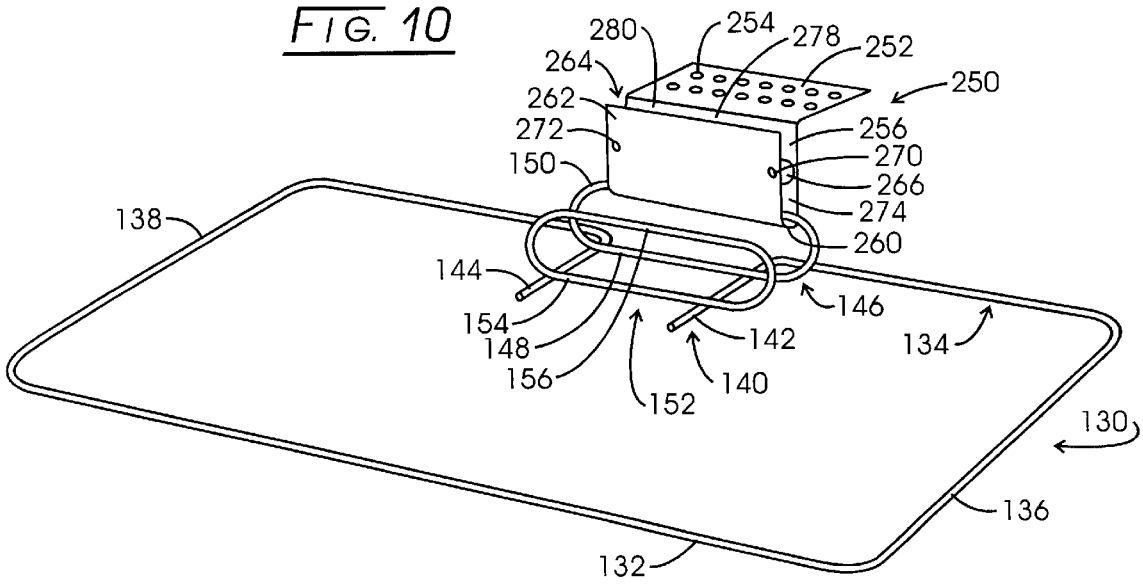
FIG. 10 is a perspective view of the wire frame components of the sign support structure described in connection with FIG. 2 in combination with a bracket fashioned from sheet metal.
Figure 11:
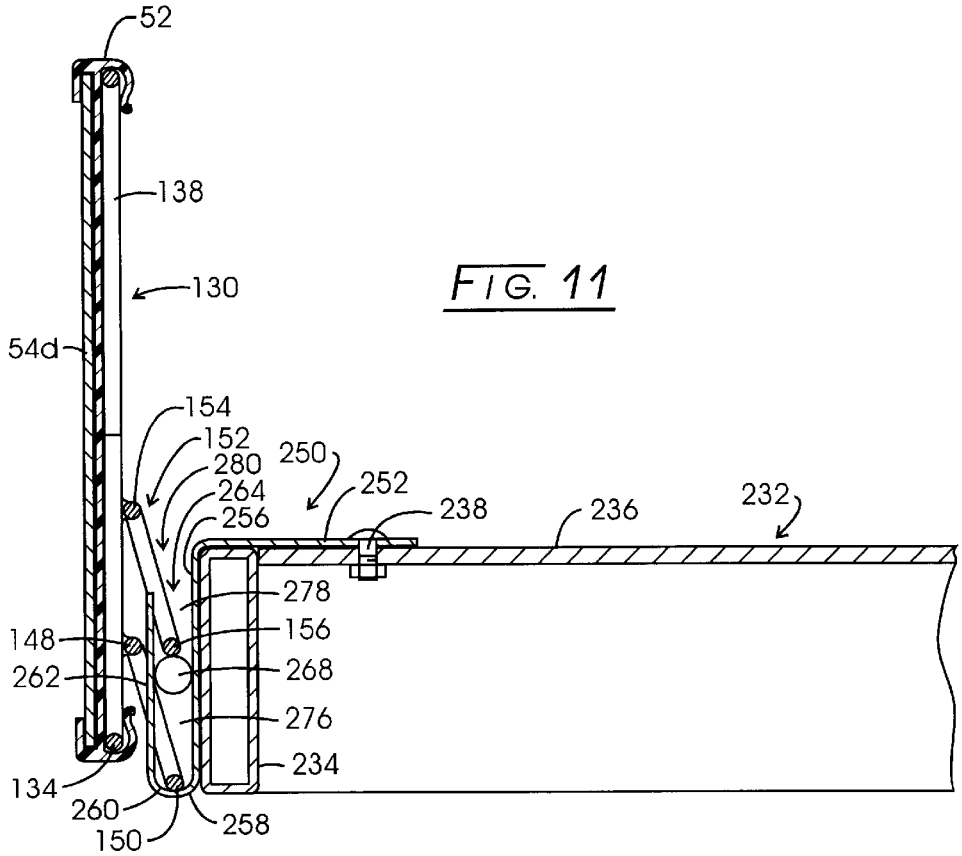
FIG. 11 is a sectional view of the sign support apparatus of the invention showing a bracket structuring described in connection with FIG. 10.

Referring to FIGS. 10 and 11 sign support frame 130 reappears from FIGS. 2 and 3, the components thereof being identified with the same numeration. However, hinge loop 146 now is operationally connected in pivotal fashion with a bracket 250. Bracket 250 is configured having a steel or suitable sheet material top plate 252 which incorporates a pattern of shelf connection apertures certain of which are revealed at 254. Integrally formed with and extending vertically downwardly from top plate 252 is an inward hinge component 256 which extends to a bottom location 258 whereupon the integral sheet structure is bent upwardly to define the bottom surface 260. From this bottom surface 260 a vertical forward hinge component 262 is formed to define a slot represented generally at 264 in cooperation with inward hinge component 256. The stop member for bracket 250 is comprised of two horizontally spaced apart spherical members one of which is seen at 266 in FIG. 10 and the other of which is seen at 268 in FIG. 11. Formed, for example of steel, the spherical members 266 and 268 are spot welded within the slot 264 as evidenced by respective weld spots 270 and 272. Spherical member 266 functions to provide a hinge closed portion 274 while spherical member 268 functions to provide a closed portion 276 as seen in FIG. 11. Within these closed portions extends hinge loop 146. Spherical members 266 and 268, as before, function to define an open receiver slot 278 extending downwardly from a slot top 280.

Since certain changes may be made in the above-described apparatus without departing from the scope of the invention herein involved, it is intended that all matter contained in the description thereof or shown in the accompanying drawings shall be interpreted as illustrative and not in a limiting sense.

What is claimed is:

1. Sign support apparatus for attachment at the forward edge region of a shelf, comprising:

a bracket connectable at said shelf forward edge region having a forwardly disposed vertically extending hinge component extending from a bottom surface to define a slot with an upwardly open top;

a stop member fixed within said slot upwardly a latching distance from said bottom surface to define a retention component and spaced downwardly from said slot top a receiver distance to define an open receiver slot;

a sign support frame having a bottom edge, a top edge, oppositely disposed side members and an intermediately disposed hinge support extending from said bottom edge;

a hinge loop fixed to and extending from said frame hinge support and having a first engagement portion extending through and moveable within said bracket retention component from a location adjacent said hinge component bottom surface into freely abutting engagement with said stop member; and a tongue member fixed to and extending from said frame hinge support spaced above said first hinge loop and having a second engagement portion positionable at a vertical location over said slot top when said first engagement portion is in said abutting contact with said stop member and slideably moveable from said vertical location downwardly within said open receiver slot into abutting contact with said stop member.

2. The sign support of claim 1 further comprising:

a sign retainer having a flat sign support face extending between rearwardly disposed upper and lower support channels respectively slideable over said support frame top edge and bottom edge.

3. The sign support of claim 2 in which:

said sign retainer upper and lower channels are configured with inwardly crimped, inwardly disposed edges compressibly engageable with said support frame side member.

4. The sign support of claim 1 in which:

said hinge loop first engagement portion and said tongue member second engagement portion are symmetrically disposed about a common plane.

5. The sign support of claim 1 in which:

said hinge loop comprises an open wire loop having first and second oppositely disposed parallel elongate sides, said first side being weldably coupled with said sign support frame hinge support, and said second side defining said first engagement portion.

6. The sign support of claim 1 in which:

said bracket hinge component comprises first and second spaced apart inward wire hinge components extending vertically downwardly along said shelf edge region and being bent upwardly to form said bottom surface, extending therefrom as respective first and second vertically upwardly disposed forward components to provide said upwardly open top defining said slot.

7. The sign support of claim 6 in which:

said stop member is an elongate wire weldably connected between said first and second spaced apart inward and forward hinge components.

8. The sign support of claim 1 in which:

said tongue member comprises an open wire loop having first and second oppositely disposed parallel elongate sides, said first side being weldably coupled with said sign support frame hinge support, and said second side defining said second engagement portion.

9. The sign support of claim 1 in which:

said sign support frame comprises an open wire frame, said bottom edge said top edge and said oppositely disposed side member defining an open wire rectangle, said hinge support being formed as inwardly upwardly bent, spaced apart component of said bottom edge.

10. The sign support of claim 9 further comprising:

a polymeric sign retainer having a flat sign support face extending between integrally formed rearwardly disposed upper and lower support channels respectively slideable over said support frame wire top edge and wire bottom edge.

11. The sign support of claim 10 in which:

said sign retainer upper and lower channels are configured with inwardly depending edges compressibly engageable with said sign support frame oppositely disposed side members.

12. The sign support of claim 1 in which:

said hinge loop first engagement portion and said tongue member second engagement portion are symmetrically disposed about a common plane; and said hinge loop and said tongue member are symmetrically disposed within mutually spaced parallel planes.

13. The sign support of claim 1 in which:

said hinge loop first engagement portion and said tongue member second engagement portion are symmetrically disposed about a common plane; and said hinge loop and said tongue member are symmetrically disposed within planes which mutually intersect at an intersection angle providing a tilting of said sign support frame when said tongue member second engagement portion is in said abutting contact with said stop member.

14. The sign support of claim 1 in which:

said bracket comprises a top plate having at least one aperture formed therein, an inward hinge component extending vertically downwardly along said shelf edge region and being bent upwardly to form said bottom surface, extending upwardly therefrom to define a vertical forward hinge component to provide said upwardly open top defining said slot.

15. The sign support of claim 14 in which said stop member comprises:

two horizontally spaced apart generally spherical members weldably connected between said inward hinge component and said forward hinge component.

16. The sign support of claim 14 in which:

said bracket top plate, said inward hinge component and said forward hinge component are mutually integrally formed of sheet material.

17. Sign support apparatus for attachment at the forward edge region of a shelf, comprising:

a bracket connectable with said shelf at said forward edge region, comprising first and second spaced apart inward wire hinge components extending vertically downwardly along said shelf edge region to a bottom location and being bent upwardly therefrom to define respective third and fourth vertically disposed outward wire hinge components spaced from respective said first and second inward hinge components to define a slot;

a stop member configured on a wire coupled within said slot, coupled between said first inward and third outward hinge components and between said second inward and fourth outward hinge components and positioned a vertical distance above said bottom location to define an elongate closed portion of said slot and further defining the bottom of an upwardly open receiving portion of said slot;

an open wire sign support frame having a bottom edge, top edge and oppositely disposed side edges defining an open wire rectangle and including a hinge support formed as inwardly, upwardly bent, spaced apart components of said bottom edge;

an open wire hinge loop having first and second oppositely disposed parallel sides, said first side being weldably coupled with said sign support frame hinge support, and said second side extending through said elongate closed portion of said slot and slideable therein substantially along said vertical distance above said bottom portion into and out of freely abuttable contact with said stop member; and an open wire tongue member having first and second oppositely disposed parallel sides, said first side being weldably coupled with said sign support frame at a location spaced above said hinge loop and positionable at a vertical location over and aligned with said upwardly open receiving portion of said slot.

18. The sign support apparatus of claim 17 in which:

a sign retainer having a flat sign support face extending between rearwardly disposed upper and lower support channels respectively slideable over said support frame top edge and bottom edge.

19. The sign support apparatus of claim 17 in which:

said open wire hinge loop second side and said tongue member second side are symmetrically disposed about a common plane.

20. The sign support apparatus of claim 17 in which:

said open wire hinge loop second side and said tongue member second side are symmetrically disposed about a common plane; and said hinge loop and said tongue member are symmetrically disposed within mutually spaced apart parallel planes.

21. The sign support apparatus of claim 17 in which:

said open wire hinge loop second side and said tongue member second side are symmetrically disposed about a common plane; and said hinge loop and said tongue member are symmetrically disposed within planes which mutually intersect at an intersection angle providing a tilting of said sign support frame when said tongue member second side is in abutting adjacency with said stop member.

22. The sign support apparatus of claim 17 in which:

said open wire hinge loop second side and said tongue member second side are symmetrically disposed about a common plane; and said hinge loop and said tongue member are symmetrically disposed within planes which mutually intersect forwardly of said shelf forward edge region at an intersection angle effecting a forward tilting of said sign support frame when said tongue member second side is in abutting contact with said stop member.

23. The sign support apparatus of claim 17 in which:

said open wire hinge loop second side and said tongue member second side are symmetrically disposed about a common plane; and said hinge loop and said tongue member are symmetrically disposed within planes which mutually intersect rearwardly of said shelf forward edge region at an intersection angle effecting a rearward tilting of said sign support.

24. The sign support apparatus of claim 17 in which:

a polymeric sign retainer having a flat sign support face extending between integrally formed rearwardly disposed upper and lower support channels respectively slideable over said support frame wire top edge and wire bottom edge.

25. The sign support apparatus of claim 24 in which:

said sign retainer upper and lower channels are configured with inwardly depending edges compressibly engageable with said sign support frame oppositely disposed side members.

* * * * *